US005156136A

United States Patent [19]

Okumura

[11] Patent Number: 5,156,136

[45] Date of Patent: Oct. 20, 1992

[54] IGNITION COIL

[75] Inventor: Mitsunao Okumura, Nagaokakyo, Japan

[73] Assignee: Murata Manufacturing Co., Ltd., Japan

[21] Appl. No.: 717,097

[22] Filed: Jun. 18, 1991

[30] Foreign Application Priority Data

Jun. 19, 1990 [JP] Japan ..... 2-160729

[51] Int. Cl.[5] ..... F02P 3/06

[52] U.S. Cl. ..... 123/621; 123/598; 123/634; 336/206

[58] Field of Search ..... 123/596, 598, 599, 604, 123/605, 621, 634, 654; 315/209 CD, 209 SC; 336/69, 200, 206

[56] References Cited

U.S. PATENT DOCUMENTS

| | | | |
|---|---|---|---|
| 3,234,430 | 2/1966 | Issler et al. | 123/598 X |
| 3,465,739 | 9/1969 | Burson | 123/599 X |
| 3,753,428 | 8/1973 | Phillips | 123/654 |
| 4,926,111 | 5/1990 | Lungu | 336/69 X |

*Primary Examiner*—Tony M. Argenbright

*Attorney, Agent, or Firm*—Ostrolenk, Faber, Gerb & Soffen

[57] ABSTRACT

An ignition coil is provided with a primary coil which includes a distributed constant circuit including inductance and capacitance. A thyristor is connected in parallel to the primary coil, and a secondary coil is magnetically coupled to the primary coil. When a predetermined voltage is supplied to the primary coil, the capacitance is charged. If the thyristor is turned-on, the capacitance is discharged sequentially with time deviation since charge of the capacitance is sequentially delayed by the inductance which is connected in parallel to the capacitance.

4 Claims, 5 Drawing Sheets

IGNITION COIL

BACKGROUND OF THE INVENTION

1. Field of the Invention

The present invention relates to an ignition coil. More specifically, the present invention relates to an ignition coil which is utilized for applying a high voltage pulse to an ignition plug of an automobile.

2. Description of the Prior Art

As shown in FIG. 11, in a conventional ignition coil 1, a primary coil 3 and a secondary coil 4 each being consist of an insulated copper wire are wound on a core 2, and a capacitor 5 is connected in parallel to the primary coil 3. Each of the primary coil 3 and the capacitor 5 is a lumped element, and a thyristor 6 is inserted between the both. Then, a damper diode 7 is connected in parallel to the primary coil 3. An input of such an ignition coil 1 is supplied with a direct current high voltage which is obtained by stepping a voltage of 12 V or 24 V of direct current from a battery up to 300–500 V of a direct current voltage by means of a DC—DC converter. The capacitor 5 is charged by the direct current high voltage. Then, by turning the thyristor 6 on, a discharging current flows from the capacitor 5 to the primary coil 3, and therefore, a voltage is induced on the secondary coil 4.

In such the ignition coil 1, the voltage induced on the secondary coil 4 becomes a sine wave-form as shown in FIG. 12. Actually, since a negative polarity side of the voltage indicated by a dotted line 8 is clamped by the damper diode 7, the voltage of the secondary coil 4 shows a wave-form having a single peak as shown by a solid line 9. Since this secondary voltage rises slowly and it takes time until the voltage reaches the peak, firing of the ignition plug is delayed and thus combustion efficiency is not good.

SUMMARY OF THE INVENTION

Therefore, a principal object of the present invention is to provide a novel ignition coil.

Another object of the present invention is to provide an ignition coil capable of making a rising of a voltage induced on a secondary coil be sharp.

An ignition coil in accordance with the present invention comprises: a primary coil including a distributed constant circuit which includes inductance and capacitance; a switching element with a control terminal connected in parallel to the primary coil; and a secondary coil magnetically coupled to the primary coil.

When a predetermined voltage is supplied to the primary coil, the capacitance of a distributed constant type is charged. Then, if the switching element is turned-one, the capacitance is discharged. At that time, discharge of the capacitance is sequentially delayed by the inductance of a distributed constant type which is connected in parallel to the capacitance. Therefore, the capacitance is sequentially discharged with time deviation. Consequently, a wave-form of a voltage induced on the secondary coil becomes a square wave-form which rises quickly. Thus, the secondary voltage can rapidly rise. As a result of rapidity of the rising of the secondary voltage, the secondary voltage can reach a peak thereof with a short time. Therefore, firing of an ignition plug is made rapid, and thus, it is possible to improve a combustion efficiency. In addition, it is possible to omit a damper diode.

An ignition plug unit in accordance with the present invention comprises: an electrically conductive casing fixed to a cylinder head and having a bottom plate and an opening; an ignition plug contained in the electrically conductive casing such that a sparking portion of the ignition plug is exposed inside the cylinder head through the opening of the electrically conductive casing and the cylinder head; a high voltage terminal formed on the ignition plug; an ignition coil contained in the electrically conductive casing and generating a high voltage; and a connection terminal attached to the ignition coil, said high voltage terminal of the ignition plug being connected to the connection terminal.

In the present invention, since the connection terminal of the ignition coil and the high voltage terminal of the ignition plug are directly coupled to each other, it is not necessary to use a high voltage cable. In addition, a high voltage portion is contained in the electricity conductive casing, an ignition noise can be reduced. Furthermore, one ignition coil is connected to one ignition plug, and therefore, it becomes unnecessary to use a distributor.

The objects and other objects, features, aspects and advantages of the present invention will become more apparent from the following detailed description of the embodiments of the present invention when taken in conjunction with accompanying drawings.

DETAILED DESCRIPTION OF THE PREFERRED EMBODIMENT

Figure 1:
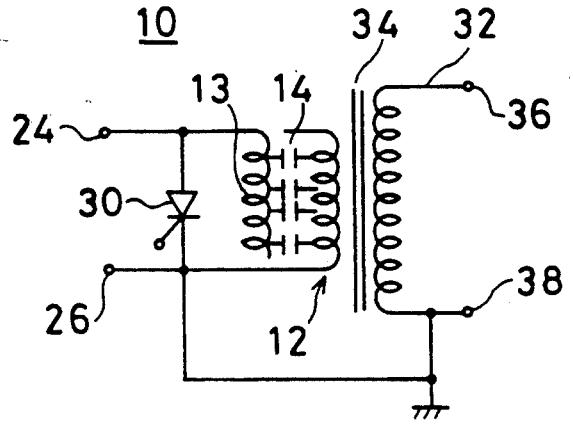
FIG. 1 is an equivalent circuit diagram showing one embodiment in accordance with the present invention.

With reference to FIG. 1, an ignitioin coil 10 of this embodiment shown includes a primary coil 12 which includes a distributed constant circuit of inductance 13 and capacitance 14.

Figure 2:
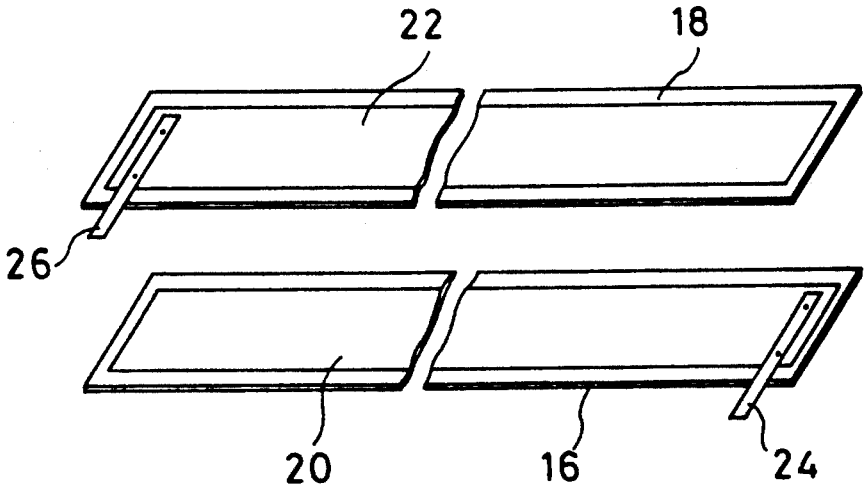
FIG. 2 is a perspective view showing developed insulation sheets of a wound unit of FIG. 1 embodiment.
Figure 3:
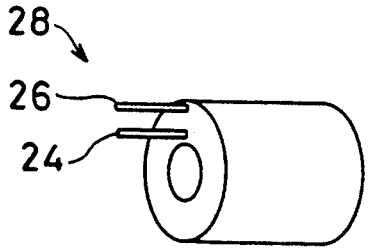
FIG. 3 is a perspective view showing the wound unit in which the insulation sheets are wound.

Such a primary coil 12 is constructed by a wound unit 28. As shown in FIG. 2, longitudinal insulation sheets 16 and 18 each being made of a polyester film, for example, are prepared. Then, on upper surfaces of the insulation sheets 16 and 18, conductive foils 20 and 22 each being made of an electrically conductive metal such as alminium, copper or the like are formed by vapor deposition or plating, respectively such that conductive foils 20 and 22 are continuously extended in longitudinal directions. A primary terminal 24 is fixed to one end portion of the conductive foil 20 formed on the insulation sheet 16 by fixing the same by spot-welding. In addition, by spot-welding, for example, a primary terminal 26 is fixed, at a side opposite to the primary terminal 24, to one end portion of the conductive foil 22 formed on the insulation sheet 18. After laminating the insulation sheets 16 and 18, if the insulation sheets 16 and 18 are wound in a cylindrical form in a manner that the conductive foil 22 formed on the insulation sheet 18 exists inside, the wound unit 28 is formed such that the primary terminals 24 and 26 are both exposed at one end surface of the wound unit 28 as shown in FIG. 3.

By the conductive foils 20 and 22 of the wound unit 28, the inductance 13 of a distributed constant type shown in FIG. 1 is formed between the primary terminals 24 and 26. Therefore, distance between the primary terminals 24 and 26 affects the inductance 13. Therefore, by changing fixing positions of the primary terminals 24 and 26, it is possible to properly adjust the inductance 13. In addition, although description will be made of another embodiment later, by forming each of the conductive foils 20 and 22 by a plurality of strips which are obtained by dividing the foil in a width direction thereof, it is also possible to adjust the inductance 13.

Furthermore, the capacitance 14 of a distributed constant type shown in FIG. 1 is formed between the conductive foils 20 and 22 because the insulation sheets 18 which is a dielectric member is inserted therebetween. The capacitance 14 is connected in parallel to the inductance 13. The capacitance 14 can be properly adjusted by an area of a portion where the conductive froils 20 and 22 opposite to each other, a dielectric constant of the insulation sheet 18, and etc. Thus, an LC distribukted constant circuit shown in FIG. 1 can be formed.

Returning to FIG. 1, a thyristor 30 which is one example of a switching element with a control terminal is connected in parallel to the primary coil 12 which is constructed by the above described wound unit 28. Then, a secondary coil 32 is magnetically coupled to the primary coil 12 via a core 34. A secondary terminal 36 of the secondary coil 32 is connected to an ignition plug 52 (FIG. 10, described later), and a secondary terminal 38 is connected to the ground together with the primary terminal 26.

To the primary terminals 24 and 26 of the ignition coil 10, although not shown, a switching power source including a DC—DC converter, for example, is connected. Then, by such a switching power source, a voltage of 12 V in case of a passenger car or 24 V in casse of a truck is stepped-up to 300–500 V of a direct current voltage to be supplied between the primary terminals 24 and 26. Responsively, the capacitance 14 of a distributed constant type is sequentially charged.

After completion of the charging, if the thyristor 30 is turned-on, charge in the capacitance 14 of a distributed constant type is sequentially discharged to the inductance 13 with occurring of time devialtion. The time deviation occurs due to a function of the LC distributed constant circuit. A core 34 is excited by a discharging current, and accordingly, a voltage is induced on the secondary coil 32. That is, a PFN (Pulse Forming Network) is constructed, and therefore, it is possible to obtain a secondary voltage of a square wave-form that rises rapidly (a rising time is about 1–10 microseconds which is about 1/10 of a rising time of the prior art) and has a wide pulse width. Therefore, a high voltage necessary for sparking of the ignition plug can be rapidly obtained, and therefore, it is possible to improve a combusion efficiency. Meanwhile a peak value of the voltage is approximately 30–35 Kv.

Figure 4:
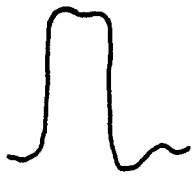
FIG. 4 is a wave-form chart showing a secondary voltage generated in FIG. 1 embodiment.

As shown in FIG. 4, the secondary voltage becomes a pulse voltage of a positive polarity, and therefore, it becomes unnecessary to use a damper diode, and therefore, it is possible to reduce the number of parts and cost.

Figure 5:
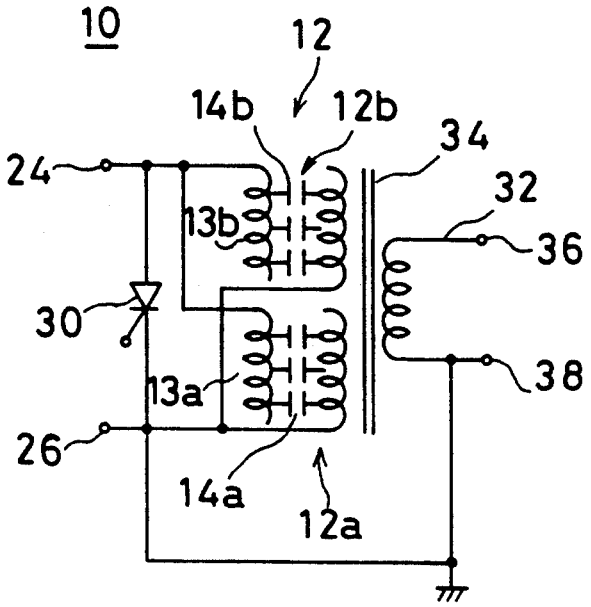
FIG. 5 is an equivalent circuit diagram showing another embodiment in accordance with the present invention.
Figure 6:
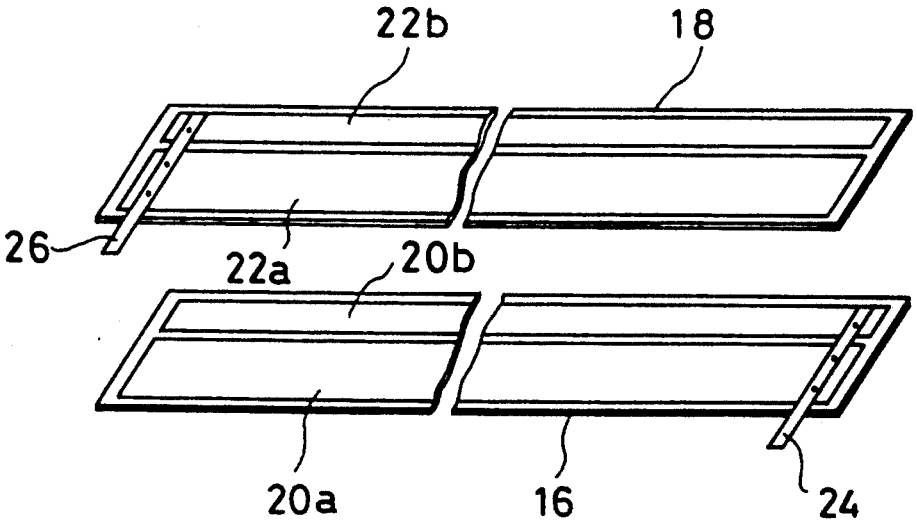
FIG. 6 is a perspective view showing developed insulation sheets forming a wound unit in FIG. 5 embodiment.

In an ignition coil 10 of another embodiment shown in FIG. 5, the primary coil 12 is constructed by parallelly connecting a primary coil portions **12*a* and 12*b*. The primary coil portion 12*a* includes a distributed constant circuit of inductance 13*a* and capacitance 14*a*, and the primary coil portion 12*b* includes a distributed constant circuit of inductance 13*b* and capacitance 14*b*. In order to manufacture such the primary coil 12, insulation sheets 16 and 18 as shown in FIG. 6 are utilized. More specifically, two insulation sheets 16 and 18 are prepared. Conductive foils 20*a* and 20*b*, and 22*a* and 22*b* which are made as parallel strip conductors by dividing in the width direction of the foil are formed on the insulation sheets 16 and 18, respectively. Then, the primary terminal 24 is fixed such that one ends of the conductive foils 20*a* and 20*b* are commonly connected to each other. In addition, the primary terminal 26 is fixed at a side opposite to the primary terminal 24 to one end of the conductive foils 22*a* and 22*b* such that the ends are commonly connected to each other. After laminating of the insulation sheets 16 and 18**, by winding the same in a cylindrical form as similar to the previous embodiment, a wound unit can be formed.

If each of the inductance **13*a* and 13*b* is made equal to the inductance 13 and each of the capacitance 14*a* and 14*b* is made equal to the capacitance 14, a discharging current can be made twice that of the previous embodiment. Therefore, it is possible to reduce internal impedance of the ignition coil 10** below ½ in compression with that previously disclosed.

Figure 7:
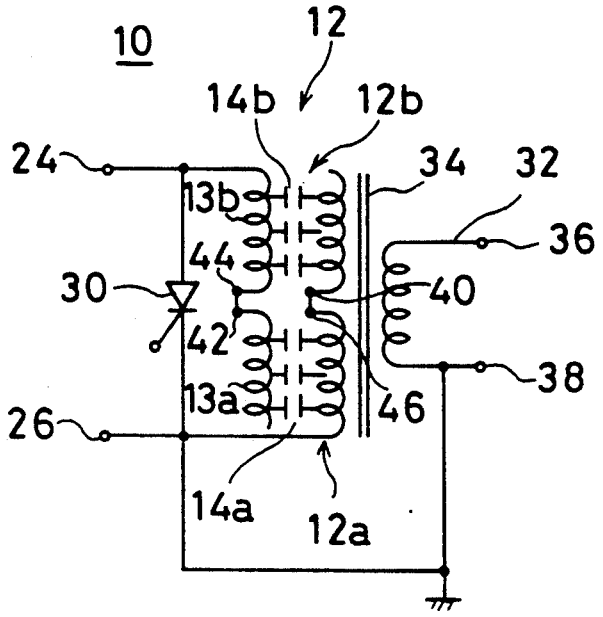
FIG. 7 is an equivalent circuit diagram showing a further embodiment in accordance with the present invention.

Furthermore, an ignition coil 10 of another embodiment as shown in FIG. 7 includes a primary coil 12 which is obtained by connecting first coil portion **12*a* and 12*b* in series to each other. The primary coil portion 12*a* forms a distributed constant circuit including inductance 13*a* and capacitance 14*a*, and the primary coil portion 12*b* forms a distributed constant circuit including inductance 13*b* and capacitance 14*b***.

Figure 9:
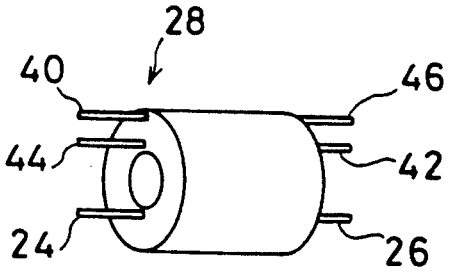
FIG. 9 is a perspective view showing the wound unit in FIG. 7 embodiment in which the insulation sheets are wound.
Figure 8:
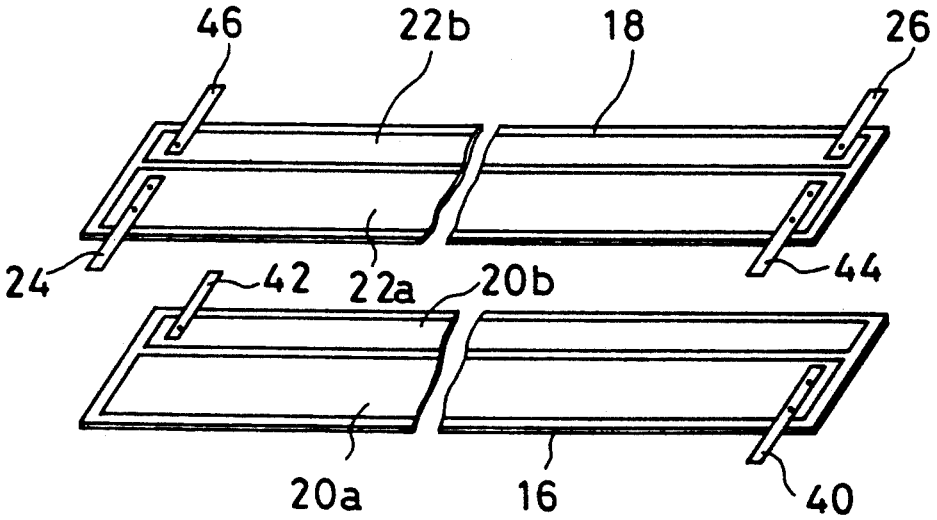
FIG. 8 is a perspective view showing developed insulation sheets forming a wound unit in FIG. 7 embodiment.

In order to manufacture such a primary coil 12, insulation sheets 16 and 18 as shown in FIG. 8 are used. More specifically, insulation sheets 16 and 18 are prepared, on which conductive foils **20*a* and 20*b*, and 22*a* and 22*b* are formed, respectively. Then, a terminal 40 is fixed to one end portion of the conductive foil 20*a*, and a terminal 42 is fixed at a side opposite to the terminal 40 to end portion of the conductive foil 20*b*. In addition, a terminal 44 and the primary terminal 24 are fixed to both ends of the conductive foil 22*a*, and the primary terminal 26 and a terminal 46 are fixed to both ends of the conductive foil 22*b*. The insulation sheets 16 and 18** thus formed are laminated, and thereafter, as similar to the previous embodiments, the insulation sheets 16 and 18 are wound in a cylindrical form to obtain a wound unit 28 shown in FIG. 9. Then, by connecting the terminal 40 and 46 in series to each other and the terminals 42 and 44 in series to each other, the primary coil portions 12*a* and 12*b* can be connected in series to each other.

In FIG. 7 ignition coil 10, if each of the inductance 13*a* and 13*b* is made equal to the inductance 13 and each of the capacitance 14*a* and 14*b* is made equal to the capacitance 14, it is possible to expand a pulse width of a voltage wave-form shown in FIG. 4 by twice approximately. As a result thereof, it is possible to make a duration of the voltage supply long, and therefore, it is possible to perform the firing of the ignition plug 52 more surely.

In addition, as done in FIG. 5 embodiment or FIG. 7 embodiment, by using a primary coil which is obtained by connecting the two primary coil portions 12*a* and 12*b* in parallel or series to each other, a degree of coupling betwee the primary coil 12 and the secondary coil 32 can be made strong, and therefore, a voltage regulation can be improved and a level of noise generation can be lowered.

Figure 11:
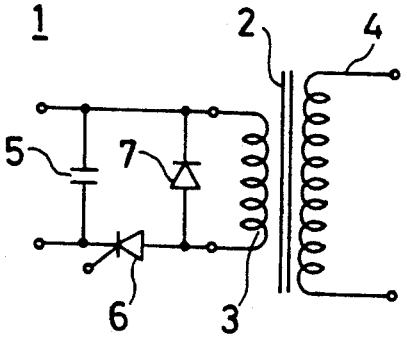
F I G. 11 PRIOR ART
FIG. 11 is an equivalent circuit diagram showing a prior art ignition coil.
Figure 12:
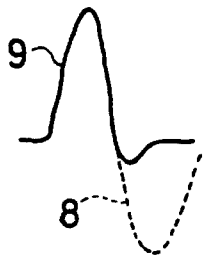
F I G. 12 PRIOR ART
FIG. 12 is a wave-form chart showing a secondary voltage generated in the prior art.
Figure 10:
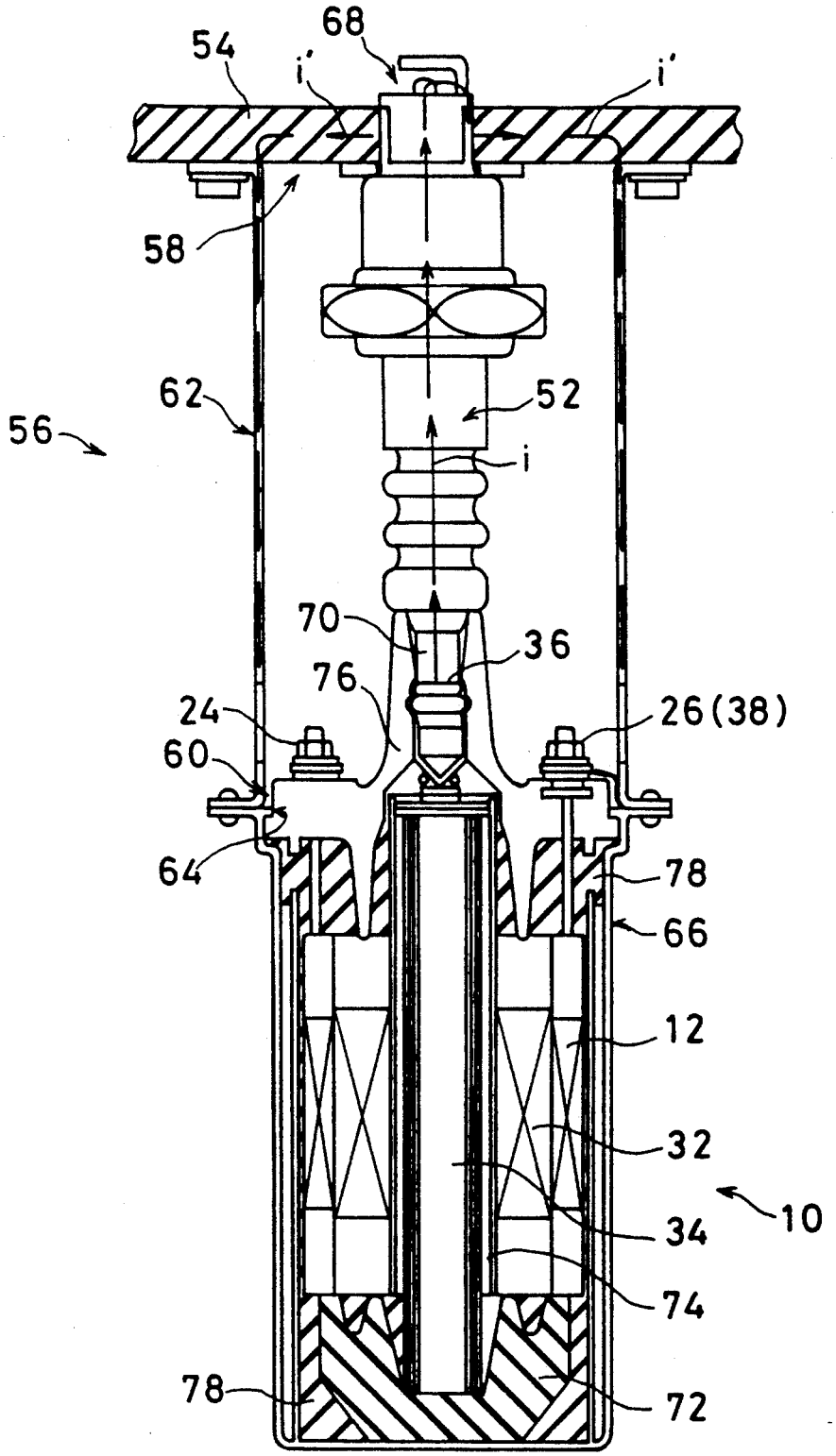
FIG. 10 is a cross-section illustrative view showing an ignition plug unit that is a still further embodiment in accordance with the present invention.

The ignition coil 10 shown in each of the previous embodiments can be utilized in an ignition plug unit 50 in FIG. 10. Meanwhile, it is pointed out in advance that in FIG. 10 embodiment, a conventional ignition coil 1 shown in FIG. 11 may be used as an ignition coil 10.

The ignition plug 50 includes a metallic casing 56 which is fixed to a cylinder head 54 and has a bottom plate and an opening. The metallic casing 56 is obtained by uniformly forming a first portion 62 having openings 58 and 60 at both ends thereof and a second portion 66 having an opening 64 at an upper end thereof. An ignition plug 52 is contained in the first portion 62, and the ignition coil 10 is contained in the second portion 66. A sparking portion 68 is formed at one end portion of the ignition plug 52, and a high voltage terminal 70 is formed at the other end. Then, the ignition plug 52 is contained in the first portion 62 such that the sparking portion 68 can be projected inside the cylinder head 54 through the opening 58 of the first portion 62 and the cylinder head 54.

A base insulator 72 is formed on a bottom portion of the second portion 66, and the ignition coil 10 is arranged on the bse insultor 72. The core 34 made of laminated steel sheets is arranged at an approximately center of an upper surface of the base insulator 72. A bobbin 74 made of insulative resin, for example is inserted to the core 34. A secondary coil 32 which is made by alternately laminating a conductor and insertion papers is wound on the bobbin 74, and the primary coil 12 being made by the wound unit 28 is further formed on the secondary coil 32. A cap 76 is attached to the opening 64 of the second portion 66, and the secondary terminal 36 is withdrawn from a center portion of the cap 76 and the primary terminals 24 and 26 and the secondary terminal 38 are withdrawn from both sides of the cap 76. By connecting the secondary terminal 36 to a high voltage terminal 70, the ignition coil 10 is directly attached to the ignition plug 52. In addition, the primary terminal 26 and the secondary terminal 38 are directly connected to each other by soldering, for example, to be connected to the metallic casing 56 which functions as ground terminal. Furthermore, inside the second portion 66, an insulation member 78 made of asphalt pitch, oil or the like is filled.

By directly attaching the ignition coil 10 to the ignition plug 52, it becomes unnecessary to use a high voltage cable. In this case, as shown in FIG. 10, a spark current i flows from the secondary terminal 36 to the cylinder head 54 through the high voltage terminal 70 and the sparking portion 68 of the ignition plug 52, and the spark current i divided on the cylinder head 54 so as to become spark currents i'. The spark currents i' flow to the secondary terminal 38 at a lower voltage side through the first portion 62. Therefore, the spark current i and i' flows in a coaxial manner, and therefore, inductance of a path of the spark currents becomes below 1/100 of that of the prior art, and therefore, an ignition noise can be reduced similarly.

In addition, the ignition plug unit 50 is constructed as a tall type; however, if the ignition plug 52 and the ignition coil 10 are bent as an L-letter shape, the ignition plug unit 50 can be made as a short type.

Furthermore, in each of the above described embodiments, a voltage induced on the secondary coil 32 can be made as arbitrary wave-form not only by connecting the primary coil portions 12*a* and 12*b* in series or parallel to each other but also by adjusting LC distributed constant by changing the inductance 13, 13*a* or 13*b* and the capacitance 14, 14*a* or 14*b*, or by adjusting a turns ratio. Furthermore, the number of the primary coil portions connected in series or parallel to each other is not limited as two, the same may be more than three. Furthermore, by forming structure in which the secondary coil 32 is sandwiched by a plurality of the primary coil portions, it is possible to increase a degree of coupling between them both. In addition, the primary coil 12 may be formed by connecting the above described wound unit 28 and a conventional wire wound type coil in series or parallel to each other. Furthermore, the secondary coil 32 may be formed by winding an insulated conductor, and therefore, as the secondary coil 32, an arbitrary type of coil can be applied.

Furthermore, each of the conductive foils may not be necessary to be formed on a whole surface of the insulation sheet and may be formed on a portion thereof. In addition, each of the insulation sheets may be PET (Polyethylene Terephthalate), PC (Polycarbonate) or other materials having a low dielectric constant.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. An ignition coil, comprising:

a primary coil including a distributed constant circuit which includes inductance and capacitance;

a switching element with a control terminal connected in parallel to said primary coil; and a secondary coil magnetically coupled to said primary coil.

2. An ignition coil in accordance with claim 1, wherein said primary coil includes a first longitudinal insulation sheet, a first conductor formed on one main surface of said first insulation sheet, a first terminal fixed to said first conductor, second insulation sheet laminated on said first insulation sheet, a second conductor formed on one main surface of said second insulation sheet, and a second terminal fixed to said second conductor, said first and second insulation sheets being wound in a manner that the same are laminated to form a wound unit.

3. An ignition coil in accordance with claim 1, wherein said primary coil includes a plurality of primary coil portions each including a distributed constant circuit of inductance and capacitance, said plurality of primary coil portions being connected in parallel to each other.

4. An ignition coil in accordance with claim 1, wherein said primary coil includes a plurality of primary coil portions each including a distributed constant circuit of inductance and capacitance, said plurality of primary coil portions being connected in series to each other.

* * * * *